US010766647B2

(12) United States Patent
Abramowicz et al.

(10) Patent No.: US 10,766,647 B2
(45) Date of Patent: Sep. 8, 2020

(54) PRESSURIZING AEROSOL CANS

(71) Applicant: CROWN Packaging Technology, Inc., Alsip, IL (US)

(72) Inventors: Daniel A. Abramowicz, Richboro, PA (US); Charles Anderson Bolton, Berwyn, PA (US)

(73) Assignee: Crown Packaging Technology, Inc., Alsip, IL (US)

( * ) Notice: Subject to any disclaimer, the term of this patent is extended or adjusted under 35 U.S.C. 154(b) by 290 days.

(21) Appl. No.: 15/624,108

(22) Filed: Jun. 15, 2017

(65) Prior Publication Data

US 2017/0361962 A1 Dec. 21, 2017

Related U.S. Application Data

(60) Provisional application No. 62/351,413, filed on Jun. 17, 2016.

(51) Int. Cl.

| | |
|---|---|
| ***B65B 31/04*** | (2006.01) |
| ***B65B 31/00*** | (2006.01) |
| ***B65D 83/38*** | (2006.01) |
| ***B65D 83/42*** | (2006.01) |
| *B65D 83/62* | (2006.01) |

(52) U.S. Cl.

CPC ..... *B65B 31/003* (2013.01); *B65B 31/044* (2013.01); *B65B 31/047* (2013.01); *B65D 83/38* (2013.01); *B65D 83/425* (2013.01); *B65D 83/42* (2013.01); *B65D 83/62* (2013.01)

(58) Field of Classification Search

CPC ... B65B 31/003; B65B 31/047; B65B 31/044; B65B 31/00; B65D 83/425; B65D 83/38; B65D 83/62; B65D 83/42

See application file for complete search history.

(56) References Cited

U.S. PATENT DOCUMENTS

| | | | | |
|---|---|---|---|---|
| 4,197,884 | A | 4/1980 | Maran | |
| 5,462,099 | A | 10/1995 | Demarest et al. | |
| 7,779,608 | B2 * | 8/2010 | Lim | B65B 31/003 53/403 |
| 8,869,842 | B2 * | 10/2014 | Smith | B65B 31/025 141/3 |
| 9,234,822 | B2 * | 1/2016 | Coleman | B01L 5/02 |
| 2001/0013379 | A1 | 8/2001 | Yquel | |
| 2005/0016622 | A1 | 1/2005 | Risch et al. | |

(Continued)

FOREIGN PATENT DOCUMENTS

WO WO 91/01257 A1 2/1991

*Primary Examiner* — Nicolas A Arnett

(74) *Attorney, Agent, or Firm* — BakerHostetler

(57) ABSTRACT

A system and corresponding method for charging an aerosol can with a compressed gas charge includes a base that is adapted for receiving a can that (i) houses a product and (ii) includes a means for injecting gas, such as a grommet or valve on the bottom of the container, and includes a compressed gas source, such as a pre-charged canister of compressed air, and air compressor, and/or an automatic or manual air pump. The can may be filled with at atmospheric pressure and then shipped while the can contains approximately atmospheric pressure. Upon receipt of the can, a user may charge the can with a compressed gas and repeat charging if needed after some of the product has been dispensed.

19 Claims, 2 Drawing Sheets

(56) References Cited

U.S. PATENT DOCUMENTS

2008/0035214 A1* 2/2008 McCormack ..... B65D 83/14
137/511
2012/0291911 A1* 11/2012 Smith ..... B65B 31/025
141/3

* cited by examiner

PRESSURIZING AEROSOL CANS

CROSS REFERENCE TO RELATED APPLICATIONS

This application claims priority to U.S. Application No. 62/351,413, filed Jun. 17, 2016, the contents of which are incorporated herein by reference in their entirety.

BACKGROUND

The invention relates to systems and methods for filling and pressurizing a container for dispensing a product, and to the corresponding containers, and more particularly to containers that can be pressurized, such as by a consumer.

Many household products are dispensed from pressurized containers through a dispensing valve, which containers are generally referred to as "aerosol containers." Conventional aerosol containers are usually pressurized by a volatile liquid propellant, which provides an adequate pressure for dispensing even after a portion of the product has been dispensed from the container.

When filling conventional aerosol products, a manufacturer fills a can with the product and promptly charges it with the volatile propellant. The filled can, in a ready-to-use form, is then shipped according to U.S. Department of Transportation rules. For example, container designs given a DOT-2Q designation must be rated to withstand 270 psi and container designs given a DOT-2P designation must be rated to withstand 240 psi.

Conventional aerosol containers may be configured such that, for example, the product and propellant are in contact, or the product is housed in a bag within the can while the propellant is housed outside the bag, or a piston separates the product from the propellant. An example of the latter is EarthSafe Dispensing Technology, marketed by Crown Cork and Seal.

Aerosol cans are moving towards non-hydrocarbon propellants using compressed gas for many reasons, such as regulatory hurdles, consumer pressure for environmental reasons, etc. But compressed gas aerosols suffer from several disadvantages, including:

- Internal can pressure decreases over time as the compressed air is depleted with use.
- A significant volume of the container is required for the non-hydrocarbon propellant (roughly 40% in typical aerosol applications).
- Unlike hydrocarbons which re-pressurize the container each time, the spray and/or delivery performance of compressed gas propellant based aerosols changes over time.

SUMMARY

An aerosol recharging system can pressurize the container with air or other gas to provide internal pressure at the desired level, both initially upon first receiving the unpressurized container and then again after initial use. The can is capable of being re-charged as many times as required to provide adequate internal pressure for effective dispensing until empty. A user, such as a post-purchase end-user, places the container on a charger and initiates a process in which an air pump or compressed gas canister pushes gas into the container to the designed pressure. The container may have a more durable grommet (compared to conventional grommets) or a valve to interface with the pressurization system and to allow initial pressurization and subsequent re-pressurization, as needed. The system may be employed for any product that is suitable for discharge by compressed gas propellants (creams, gels, fragrances, etc.). The compressed gas, such as air, nitrogen, carbon dioxide, and the like, can be conventional.

The aerosol container can be filled on an unpressurized filling line (at atmospheric pressure) much like a beverage filling line, and preferably is shipped at an atmospheric or near atmospheric internal pressure. For example, it may be advantageous for thin walled containers to provide some pressurization merely for stiffening the container structure during shipping. In this regard, "near atmospheric pressure" used herein refers to internal pressure that is insufficient for dispensing the product.

More information is provided in the Section below marked Claims.

BRIEF DESCRIPTION OF THE DRAWINGS

Different embodiments of the present invention will now be described, by way of example only, with reference to the accompanying drawings, in which.

DETAILED DESCRIPTION OF ILLUSTRATIVE EMBODIMENTS

Figure 1:
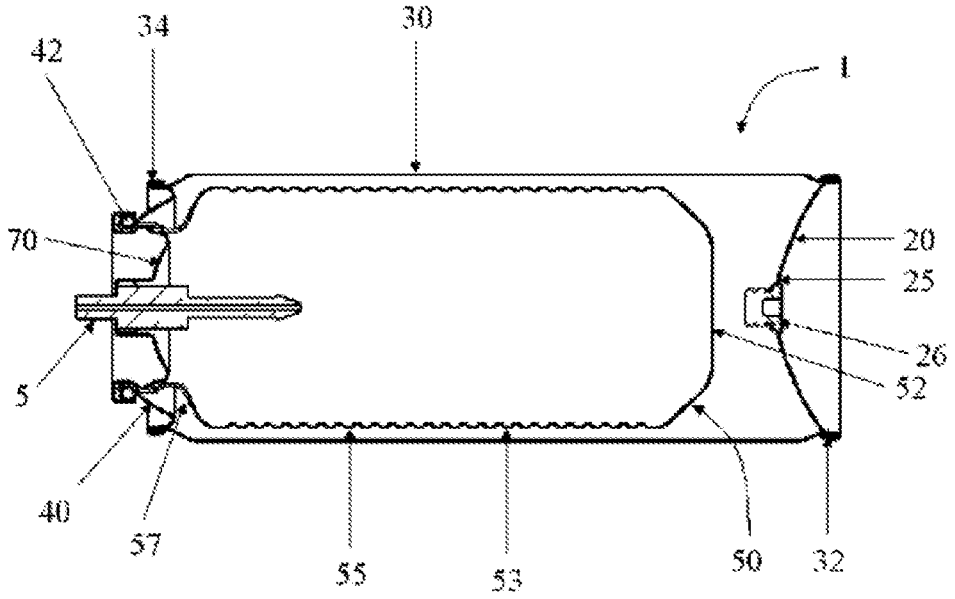
FIG. 1 shows a cross section view of an example of an aerosol container having a grommet in its bottom.

An aerosol container includes a grommet or valve through which a compressed gas can be inserted. As illustrated in FIG. 1, an aerosol container 1 includes a body 30, a cone 40, a valve cup 70, and a valve 5. Body 30 includes a sidewall and a base 20.

The base 20 defines a charging port or aperture 25, through which propellant is inserted into the aerosol container 1. The propellant (not shown in the figures) is a compressed gas, preferably compressed air. Base 20 defines a charging port or aperture 25, through which compressed gas is inserted into the aerosol container 1. The internal pressure is used to drive the product in the aerosol container 1 out of the valve 5, when it is opened for use by a consumer.

Aerosol container 1 in the embodiment shown includes a bag 50 inside body 30. Exemplary bag 50 has a sidewall 53 that includes ribs 55 around the circumference of the bag 50. The inside of the bag 50 defines a product compartment and the space outside bag 50, between the bag 50 and the body 30, defines a compartment in which compressed gas resides, after it is introduced via the charging port 25. The product, which is not shown in FIG. 1, can be any product suitable for dispensing in an aerosol container, such as creams, gels, fragrances, etc.

The compressed air compartment is sealed by bottom 20 and a grommet 26. The present invention is not limited to a container having a bag, nor to the grommet or the location of the grommet shown FIG. 1. Rather, the present invention encompasses any container or valve structure that is consistent with or defined in the claims, including without limitation structures in which the compressed gas is in contact with the product and any configuration (such as a piston, bag, and the like) in which the compressed gas is separated from the product. Further, the present invention encompasses any means for charging a container with compressed gas by a consumer.

The top of container 1 includes a valve 5, which preferably is conventional, that is mounted in valve cup 70 and is in fluid communication with the product. Valve cup 70 is attached to cone 40 by conventional means. Cone 40 is seamed to a neck 57 of body 30.

Figure 2:
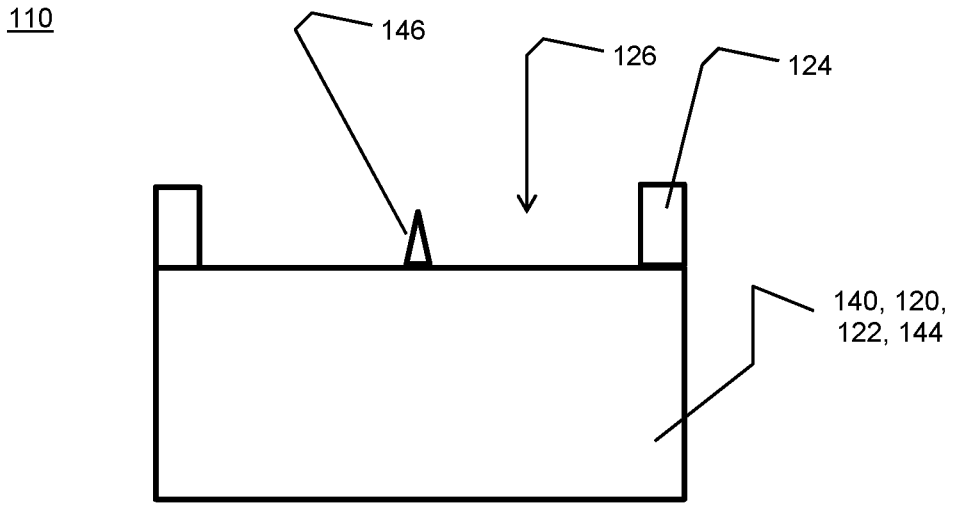
FIG. 2 is a schematic of a charging station.

FIG. 2 shows a schematic of a charging/recharging device 110. Device 110 includes a cup 120 and a compressed gas delivery system 140. Cup 120 includes a base 122 and a sidewall 124 that forms a recess 126 for receiving the lower portion of can body 30. Delivery system 140 includes a compressed gas source 142, a communication channel 144, and an interface 146, preferably male, such as a needle that can engage the grommet of valve of the container.

Delivery system 140 encompasses any source of compressed gas, including without limitation an air pump or compressor, a canister of compressed air or other compressed gas, and the like. The compressed gas canister can be replaceable, or the delivery system or recharging device can be single-use and disposable. Optionally, device 110 may be matched to the container or container requirements, such that delivery system 140 pressurizes container 1 to a desired or predetermined pressure, which can be chosen to optimize the delivery and spray performance, and/or to minimize the material used in the container. Because the can is pressurized as described, aerosol can 1 has a maximum internal pressure that is lower than that of a conventional aerosol can, which lower pressure enables lightweighting compared with conventional aerosol cans. The predetermined pressure at which aerosol can is pressurized by compressed gas system 140 may be chosen according to both spray performance and can lightweighting according to factors that will be understood by persons familiar with aerosol can technology. For an example of means for making device 110 and can 1 work together, device 110 and container 1 can be physically designed to connect or interlock together, and male interface 146 can be physically designed to connect or interlock together with grommet 36 of the corresponding valve. The connections or interlocks, for example, can be key and keyway slots that align only when device 110 is matched with the appropriate container 1. Alternatively, an electronic or other non-physical lock out may be used. In this way, sufficient pressure can be safely achieved without undue overfilling.

Preferably, a consumer engages container 1 with device 110 by inserting the can into recess 126, according to mechanical or electronic interlocks that may be provided. Upon interface 146 engaging the grommet or vale and satisfying any interlocks and safety conditions, delivery system 140 releases gas from compressed gas source 142. System 140 may be matched to a particular container, such that system 140 is capable of only pressurizing a container to a single predetermined and designed pressure. Alternatively, system 140 may be interlocked and controlled to recognize one or more particular containers, and in this way provide a predetermined and designed pressure that matches the particular container. Alternatively, compressed gas source can include an overpressure release valve to prevent overfilling.

To manufacture the package, a manufacturer can fill a product into a can on a conventional filling line at atmospheric or near atmospheric pressure and then (preferably) seal the container such that it is for pressurizing. The filled container can then be shipped with only atmospheric or near atmospheric pressure inside. The inventors believe that the above configurations and processes would reduce the cost and complexity of aerosol can filling operations, as they could resemble beverage filling operations, as well as the following advantages:

Embodiments of aerosol containers according to the present invention can be smaller and deliver the same amount of product, as today approximately 40% of the container volume is used for the compressed air propellant.

DOT and other testing requirements for cans would be substantially simplified, allowing lightweighting of containers, as non-pressurized containers or containers having near atmospheric pressure would be used in shipment. In preferred embodiments, the containers would not be subject to DOT shipping regulations, such as those pertaining to DOT-2Q and DOT-2P regulations.

Containers in use would be pressurized to lower pressures reducing container structural requirements as well. This is because only the pressure required for one use is needed (perhaps 3 bar vs. 7-8 bar that is sometimes used to assure adequate pressure at the point at which most of the product has already been dispensed).

The present invention could enable more widespread use of less expensive plastic aerosols which do not have the barrier performance to retain pressure of long time periods. In that regard, body 30 cold be formed by a conventional plastic.

Indoor are quality is improved because compressed gas is used in place of a conventional propellant, such as a volatile hydrocarbon compounds including propane, butane, isobutene, DME, and methyl ethyl ether.

What is claimed:

1. A method for filling and using a product in an aerosol can, comprising the steps of:

a. filling a product into a container positioned within a can at atmospheric pressure;

b. shipping the can after the filling step (a) while the can contains approximately atmospheric pressure;

c. interlocking the can to a compressed gas delivery system such that an interlock condition is satisfied;

d. charging a compartment within the can with a compressed gas from the gas delivery system after the shipping step (b) and after the interlock condition is satisfied, the compartment being a space outside of the container; and e. charging the can after a portion of the product has been dispensed after the charging step (d).

2. The method of claim 1, wherein the can includes a bottom, a sidewall, a top, and a dispensing valve affixed to the top.

3. The method of claim 2, wherein the bottom includes a reusable grommet or a filling valve.

4. The method of claim 1, wherein the can is any one of a drawn and ironed metal can, an impact extruded metal can, a metal can having a longitudinal welded seam and a seamed-on bottom, and a plastic container.

5. The method of claim 4, wherein the metal can comprises aluminum or steel.

6. The method of claim 1, wherein the can is pressurized to less than 6 bar.

7. The method of claim 1, wherein the can is pressurized to between 2 and 5 bar.

8. The method of claim 1, wherein the can is pressurized to approximately 3 bar.

9. The method of claim 1, wherein the can is configured such that during shipping DOT-2P and DOT-2Q shipping regulations do not apply.

10. The method of claim 1, wherein the compressed gas comprises a propellant gas.

11. A method for delivering product in an aerosol can, comprising the steps of:

a. filling a product into a container positioned within a can at atmospheric pressure;

b. shipping the can after the filling step (a) while the can contains approximately atmospheric pressure; wherein a compartment within the can is adapted for being charged with a compressed gas after the shipping step (b) and after the can is interlocked with a compressed gas delivery system such that an interlock condition is satisfied, wherein the compartment is a space outside of the container; and the compartment within the can is adapted for being recharged after a portion of the product has been dispensed after a first charge.

12. The method of claim 11, wherein the can includes a bottom, a sidewall, a top, and a dispensing valve affixed to the top.

13. The method of claim 12, wherein the bottom includes a reusable grommet or a filling valve.

14. The method of claim 11, wherein the can is any one of a drawn and ironed metal can, an impact extruded metal can, a metal can having a longitudinal welded seam and a seamed-on bottom, and a plastic container.

15. The method of claim 14, wherein the metal can comprises aluminum or steel.

16. The method of claim 11, wherein the can is pressurized to less than 6 bar.

17. The method of claim 11, wherein the can is pressurized to between 2 and 5 bar.

18. The method of claim 11, wherein the can is pressurized to approximately 3 bar.

19. The method of claim 11, wherein the can is configured such that during shipping DOT-2P and DOT-2Q shipping regulations do not apply.

* * * * *